US009837208B2

(12) United States Patent
Nakao et al.

(10) Patent No.: US 9,837,208 B2
(45) Date of Patent: Dec. 5, 2017

(54) INDUCTOR APPARATUS AND INDUCTOR APPARATUS MANUFACTURING METHOD

(71) Applicant: FUJITSU LIMITED, Kawasaki-shi, Kanagawa (JP)

(72) Inventors: Hiroshi Nakao, Yamato (JP); Yu Yonezawa, Sagamihara (JP); Takahiko Sugawara, Kawasaki (JP); Yoshiyasu Nakashima, Kawasaki (JP); Yoshikatsu Ishizuki, Yokohama (JP); Shinya Sasaki, Ebina (JP); Shinya Iijima, Hadano (JP)

(73) Assignee: FUJITSU LIMITED, Kawasaki (JP)

( * ) Notice: Subject to any disclaimer, the term of this patent is extended or adjusted under 35 U.S.C. 154(b) by 253 days.

(21) Appl. No.: 14/540,674

(22) Filed: Nov. 13, 2014

(65) Prior Publication Data

US 2015/0200050 A1 Jul. 16, 2015

(30) Foreign Application Priority Data

Jan. 16, 2014 (JP) ..... 2014-006121

(51) Int. Cl.

| | |
|---|---|
| ***H01F 5/00*** | (2006.01) |
| ***H01F 27/28*** | (2006.01) |
| ***H01F 41/22*** | (2006.01) |
| ***H01F 17/04*** | (2006.01) |
| *H01F 17/00* | (2006.01) |
| *H01F 17/06* | (2006.01) |
| *H01F 38/02* | (2006.01) |

(52) U.S. Cl.

CPC ..... *H01F 41/22* (2013.01); *H01F 17/04* (2013.01); *H01F 2017/002* (2013.01); *H01F 2017/065* (2013.01); *H01F 2038/026* (2013.01); *Y10T 29/4902* (2015.01)

(58) Field of Classification Search

CPC ..... H01F 5/00; H01F 27/28
USPC ..... 336/200, 232
See application file for complete search history.

(56) References Cited

U.S. PATENT DOCUMENTS 4,758,808 A * 7/1988 Sasaki ..... H01F 17/04 333/185
5,815,060 A 9/1998 Matsumoto et al.
(Continued)

FOREIGN PATENT DOCUMENTS

JP 06029134 A * 2/1994
JP 06120036 A * 4/1994
(Continued)

OTHER PUBLICATIONS

Japanese Office Action of related Japanese Patent Application No. 2014-006121 dated Oct. 3, 2017.

*Primary Examiner* — Tsz Chan
(74) *Attorney, Agent, or Firm* — Arent Fox LLP

(57) ABSTRACT

An inductor apparatus includes: a substrate including an electrical insulation property and a non-magnetic material; and a plurality of inductors disposed in the substrate so as to extend from a first surface of the substrate to a second surface of the substrate, each of the plurality of inductors including: an inductor conductive part that has an electrical conductivity and extends in a thickness direction of the substrate; and a magnetic layer that covers a side of the inductor conductive part and include a relative permeability and a soft magnetic material.

11 Claims, 27 Drawing Sheets

(56) References Cited

U.S. PATENT DOCUMENTS 6,153,290 A * 11/2000 Sunahara ..... H01L 21/4857 156/89.16
7,923,814 B2 * 4/2011 Jeong ..... H01L 21/2855 257/528
2003/0011459 A1 * 1/2003 Hasegawa ..... B82Y 10/00 336/200
2003/0067376 A1 * 4/2003 Maenosono ..... H05B 6/38 336/174
2005/0116803 A1 * 6/2005 Choi ..... B82Y 25/00 336/223
2005/0190035 A1 * 9/2005 Wang ..... H01F 17/0013 336/200
2007/0139976 A1 * 6/2007 deRochemont ..... B82Y 30/00 363/17
2007/0257761 A1 * 11/2007 Mano ..... H01F 17/0006 336/200
2008/0002380 A1 1/2008 Hazucha et al.
2008/0007925 A1 1/2008 Kariya et al.
2008/0194058 A1 8/2008 Kwon et al.
2009/0068400 A1 * 3/2009 Lotfi ..... H01F 17/0006 428/138
2009/0153281 A1 * 6/2009 Rofougaran ..... H01L 23/48 336/200
2009/0224863 A1 9/2009 Mano et al.
2009/0225525 A1 9/2009 Mano et al.
2010/0117779 A1 5/2010 Mano et al.
2010/0141369 A1 * 6/2010 Mori ..... H01F 17/0013 336/200
2010/0144099 A1 6/2010 Kwon et al.
2010/0188186 A1 * 7/2010 Urata ..... B22F 3/006 336/233
2011/0102122 A1 5/2011 Mano et al.
2011/0128111 A1 * 6/2011 Roozeboom ..... H01F 17/0006 336/84 R
2013/0069756 A1 * 3/2013 Wolf ..... H01F 17/04 336/221
2014/0272452 A1 9/2014 Kamidaki et al.

FOREIGN PATENT DOCUMENTS

JP 06151185 A * 5/1994
JP H07-201610 A 8/1995
JP 10-233469 A 9/1998
JP 2005-150490 A 6/2005
JP 2008-021996 A 1/2008
JP 2008-537355 A 9/2008
JP 2010-507225 A 3/2010
WO WO 2007/129526 A1 11/2007
WO WO 2013/042671 A1 3/2013

* cited by examiner

INDUCTOR APPARATUS AND INDUCTOR APPARATUS MANUFACTURING METHOD

CROSS-REFERENCE TO RELATED APPLICATION

This application is based upon and claims the benefit of priority of the prior Japanese Patent Application No. 2014-006121, filed on Jan. 16, 2014, the entire contents of which are incorporated herein by reference.

FIELD

The embodiments discussed herein are related to an inductor apparatus and an inductor apparatus manufacturing method.

BACKGROUND

An inductor apparatus is used in a power-supply circuit and the like.

Related art is discussed in Japanese Laid-open Patent Publication No. 10-233469, Japanese Laid-open Patent Publication No. 2008-21996, Japanese Laid-open Patent Publication No. 2005-150490, Japanese National Publication of International Patent Application No. 2008-537355, or International Publication Pamphlet No. WO 2007/129526.

SUMMARY

According to an aspect of the embodiments, an inductor apparatus includes: a substrate including an electrical insulation property and a non-magnetic material; and a plurality of inductors disposed in the substrate so as to extend from a first surface of the substrate to a second surface of the substrate, each of the plurality of inductors including: an inductor conductive part that has an electrical conductivity and extends in a thickness direction of the substrate; and a magnetic layer that covers a side of the inductor conductive part and include a relative permeability and a soft magnetic material.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

As integrated circuits are miniaturized with higher performance, the voltage supplied to the integrated circuits is lowered. In addition, to reduce power consumption, the power management granularity is refined, and the responsivity of supplied power is improved with respect to the power supply.

A power supply method referred to as a point of load (POL) power supply is provided.

When a POL power supply is used, the power supply is disposed adjacent to an integrated circuit, which is a load. When the power supply is disposed adjacent to the integrated circuit to which power is supplied, a substrate resistance, parasitic capacity, or parasitic inductance that may be generated between the power supply and integrated circuit is reduced, and the response speed is improved.

For example, a step-down DC-DC converter is used as the POL power supply.

Figure 1:
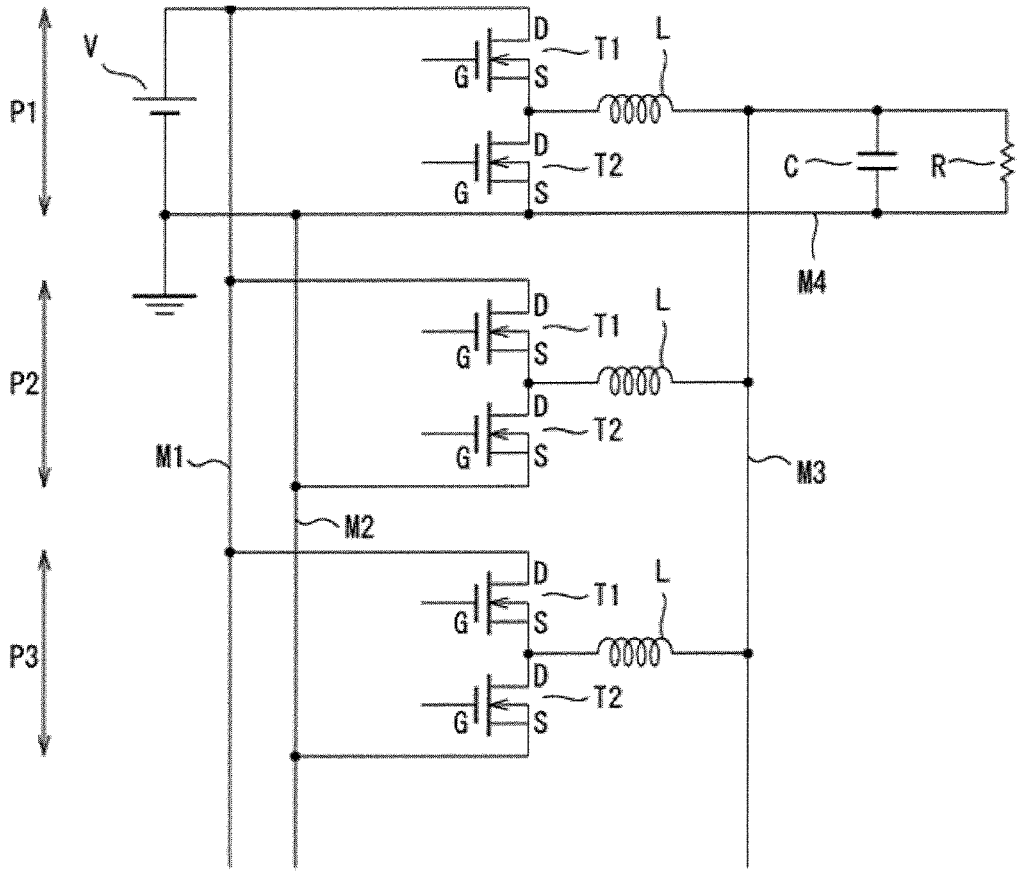
FIG. 1 illustrates an example of a step-down DC-DC converter.

FIG. 1 illustrates an example of a step-down DC-DC converter.

The DC-DC converter illustrated in FIG. 1 includes a first phase P1 to a third phase P3, each of which has a pair of transistors T1, T2. In each phase, a high-side transistor T1 and a low-side transistor T2 are coupled in series. A drain D of the high-side transistor T1 is coupled with a wiring M1 that is coupled with a power supply V. A source S of the low-side transistor T2 is coupled with a ground wiring M2 that is coupled with a ground. A control signal from a control circuit is input to a gate G of each of the high-side transistor T1 and the low-side transistor T2 such that the high-side transistor T1 and the low-side transistor T2 are controlled to be alternately turned on and off.

A source S of the high-side transistor T1 and a drain D of the low-side transistor T2 are coupled with an inductor L. The inductor L is disposed for each phase. The output from the inductor L in each phase is coupled with an output wiring M3 that is coupled with a load R via a capacitive element C. The load R and the capacitive element C are coupled with the ground wiring M2 via a wiring M4.

The DC-DC converter illustrated in FIG. 1 includes three phases, three pairs of transistors, and three inductors. The number of phases may be set as appropriate in accordance with the output current desired for the DC-DC converter.

When high-output power supplies are desired, the DC-DC converter may have several dozen to several hundred phases.

When high-output power supplies are desired while there is a demand for small-sized POL power supplies, pairs of transistors and inductors are disposed in line with the number of phases.

Miniaturization technologies for semiconductor devices may be applied to small-sizing of transistors.

On the other hand, for small-sizing of inductors, to dispose a plurality of inductors in high density, chip inductors or thin-film pattern inductors may be used.

Because the chip inductors are mounted to a circuit substrate externally, there may be a limitation on high-density mounting.

When the thin-film pattern inductors are used, because the width of a thin-film pattern is large so that a large current is flown in response to high output, there may be a limitation on high-density mounting. When magnetic film cores are used together with conductive coil patterns to improve an inductance, a manufacturing process may be complicated.

In response to higher responsivity and small-sizing of POL power supplies, a switching frequency for a control signal to be input to a gate of a transistor is set high, and therefore an inductor may have a high inductance.

Figure 2:
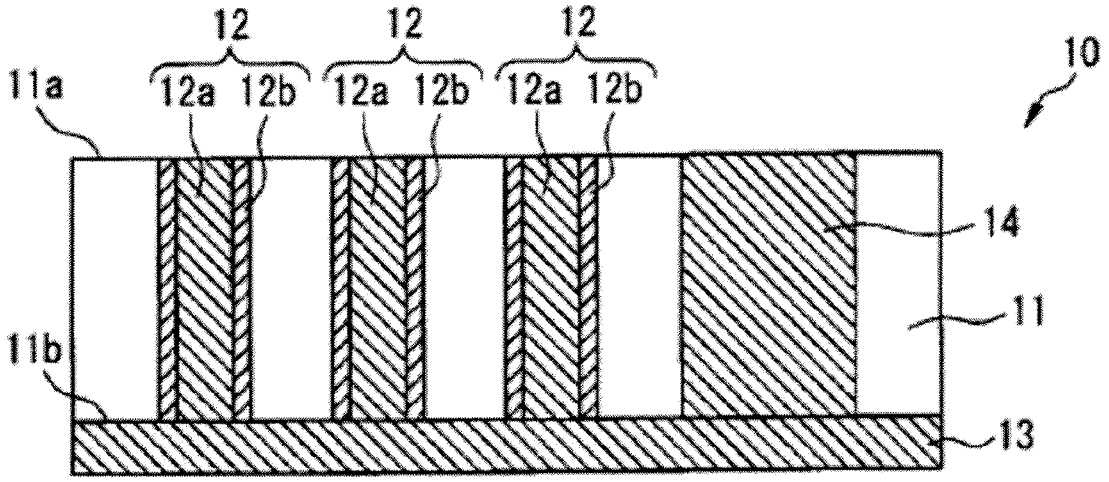
FIG. 2 illustrates an example of a cross-sectional view of an inductor apparatus.
Figure 3:
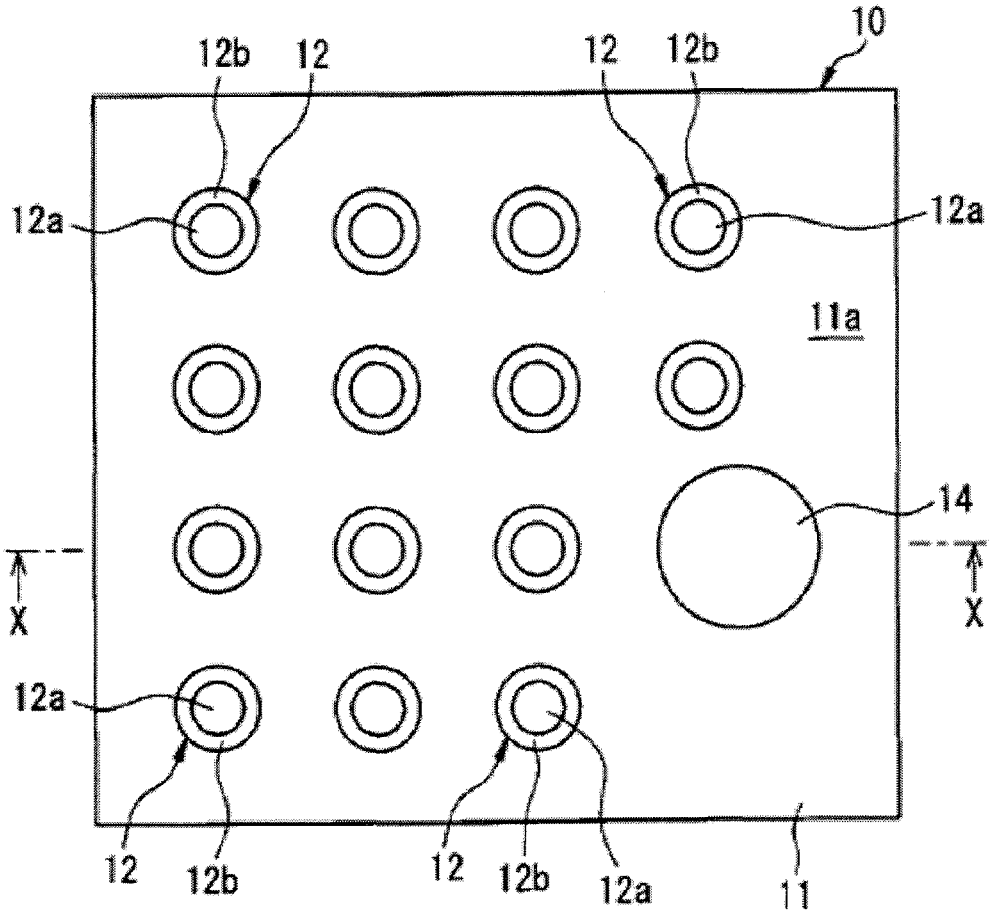
FIG. 3 illustrates an example of a plan view of an inductor apparatus.

FIG. 2 illustrates an example of a cross-sectional view of an inductor apparatus. FIG. 3 illustrates an example of a plan view of an inductor apparatus. FIG. 2 is a cross-sectional view along line II-II in FIG. 3.

An inductor apparatus 10 includes a inductor substrate 11 that has an electrical insulation property and is of a non-magnetic material, and a plurality of inductors 12 disposed in the inductor substrate 11 so as to extend from a first surface 11*a* to a second surface 11*b* of the inductor substrate 11.

Each inductor 12 includes an inductor conductive part 12*a* that has an electrical conductivity and extends in a thickness direction of the inductor substrate 11, and a magnetic layer 12*b* that covers a side of the inductor conductive part 12*a*, has a relative permeability of 5000 or more, and includes a soft magnetic material.

Each inductor conductive part 12*a* has a vertically long columnar shape. Both end surfaces in a longitudinal direction are exposed from the first surface 11*a* and the second surface 11*b* of the inductor substrate 11.

Each magnetic layer 12*b* is disposed so as to cover a side of the columnar-shaped inductor conductive part 12*a*, and has a hollow cylindrical shape.

The inductor apparatus 10 includes a first conductive part 14 that has an electrical conductivity and extends from the first surface 11*a* to the second surface 11*b* of the inductor substrate 11. The first conductive part 14 has a vertically long columnar shape, and both end surfaces in a longitudinal direction are exposed from the first surface 11*a* and the second surface 11*b* of the inductor substrate 11.

The inductor apparatus 10 includes a connection conductive layer 13 that is disposed on the second surface 11*b* of the inductor substrate 11 and electrically couples the end of each inductor conductive part 12*a* on the side of the second surface 11*b* in parallel. The connection conductive layer 13 electrically couples the end of the first conductive part 14 on the side of the second surface 11*b* and the ends of the inductor conductive parts 12*a* on the side of the second surface 11*b*. A current flowing through the plurality of inductors 12 flows to the first conductive part 14 via the connection conductive layer 13. Therefore, the diameter or cross-sectional area of the first conductive part 14 may be formed to be larger than that of each inductor conductive part 12*a* such that resistance of the first conductive part 14 is low.

The inductor apparatus 10 may be used as, for example, an inductor for a POL power supply having a plurality of phases.

Figure 4:
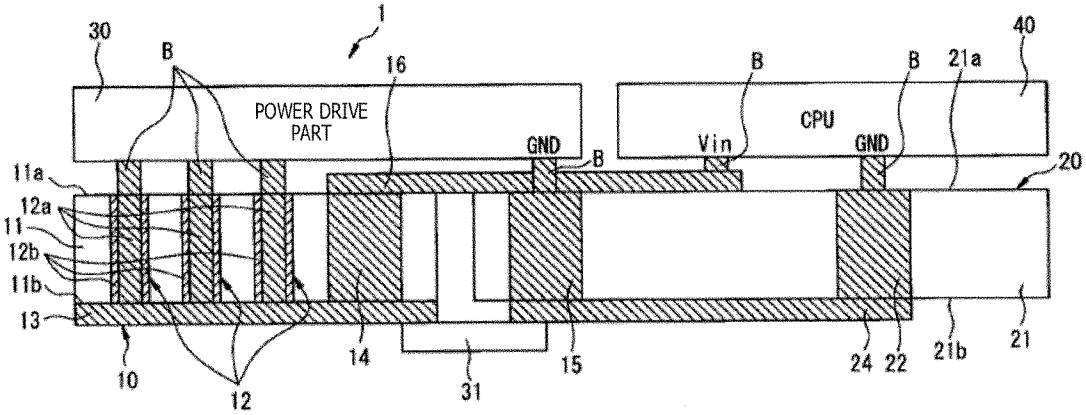
FIG. 4 illustrates an example of a power-supply apparatus.
Figure 5:
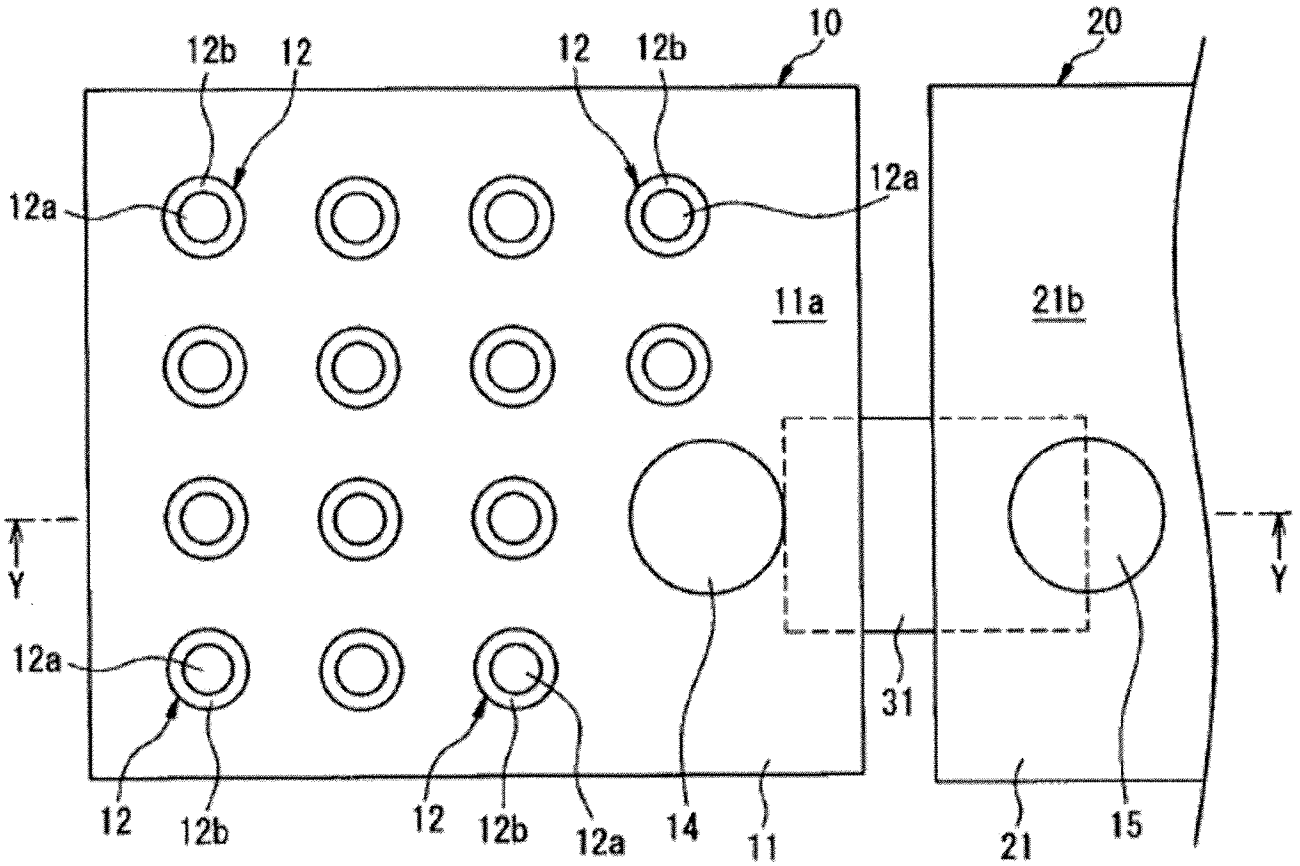
FIG. 5 illustrates an example of a power-supply apparatus.

FIGS. 4 and 5 illustrate an example of a power-supply apparatus. The power-supply apparatus may include an inductor apparatus. FIG. 4 is a cross-sectional view along line Iv-Iv in FIG. 5.

A power-supply apparatus 1 may be a DC-DC converter for a POL power supply, and steps down externally input DC power and supplies an adjacent CPU 40 with the DC power that has been stepped down.

The power-supply apparatus 1 includes the inductor apparatus 10 and a power drive part 30 that is coupled with each inductor 12 of the inductor apparatus 10 via a bump B. The power drive part 30 has phases corresponding to the number of inductors 12 of the inductor apparatus 10. The power drive part 30 has a pair of a high-side transistor and a low-side transistor for each inductor 12. Sources of the high-side transistors and drains of the low-side transistors are coupled with the inductors 12 via the bumps B. A control signal having a certain switching frequency is input to gates of the high-side transistors and the low-side transistors.

The power-supply apparatus 1 includes a connection apparatus 20 that electrically couples the inductor apparatus 10 with the CPU 40. The connection apparatus 20 includes an electrically insulating connection substrate 21, and a second conductive part 15 and a third conductive part 22 that have an electrical conductivity and are disposed in the connection substrate 21 so as to extend from a first surface 21*a* to a second surface 21*b* of the connection substrate 21. The second conductive part 15 and the third conductive part 22 have a vertically long columnar shape. Both end surfaces in a longitudinal direction are exposed from the first surface 21*a* and the second surface 21*b* of the connection substrate 21.

The connection apparatus 20 includes a wiring layer 24 that is disposed on the second surface 21*b* of the connection substrate 21 and electrically couples the end of the second conductive part 15 on the side of the second surface 21*b* and the end of the third conductive part 22 on the side of the second surface 21*b*.

The end of the second conductive part 15 on the side of the first surface 21*a* is electrically coupled with a ground terminal GND of the power drive part 30 via the bump B.

The end of the third conductive part 22 on the side of the first surface 21*a* is electrically coupled with a ground terminal GND of the CPU 40 via the bump B.

The connection conductive layer 13 of the inductor apparatus 10 is electrically coupled with the wiring layer 24 of the connection apparatus 20 via a capacitive element 31.

The end of the first conductive part 14 of the inductor apparatus 10 on the side of the first surface 11*a* is electrically coupled with a power input terminal Vin of the CPU 40 via a wiring layer 16 and the bump B.

When the power-supply apparatus 1 illustrated in FIG. 4 is compared with the circuit diagram of the DC-DC converter illustrated in FIG. 1, the inductors 12 may correspond to the inductors L, the capacitive element 31 may correspond to the capacitive element C, the connection conductive layer 13 may correspond to the output wiring M3, and the wiring layer 24 may correspond to the wiring M4.

As illustrated in FIG. 5, the inductor apparatus 10 has 14 inductors 12 disposed in an array form and one first conductive part 14, and may output DC power of 14 phases. When a current capacity of one phase is 1 A, the output capacity of the inductor apparatus 10 may be 14 A. For example, when the diameter of each inductor 12 is 0.1 mm, the diameter of the first conductive part 14 is 0.4 mm, and the inductors 12 and the first conductive part 14 are arranged at a spacing of 0.2 mm, the area of the inductor apparatus 10 may be approximately 2.5 $mm^2$. When 40 inductor apparatuses 10 are used, a POL power supply having an output capacity of 14×40 A may be obtained with an area of approximately 2.5×40 $mm^2$.

The magnetic layers 12*b* may include a soft magnetic material. The soft magnetic material is a magnetic material with a small coercive force and a large relative permeability. To enable the inductor 12 to have a high inductance and operate at a high switching frequency, the relative permeability of the magnetic layer 12*b* may be 5000 or more. From this viewpoint, the relative permeability of the magnetic layer 12*b* may be 10000 or more, specifically, 20000 or more, or more specifically, 30000 or more. In view of a material of the magnetic layer 12*b* to be actually used, the upper limit of the relative permeability of the magnetic layer 12*b* may be approximately 50000.

As a saturation magnetization becomes higher, a larger amount of current is flown through the inductor 12 to operate the inductor 12 without causing magnetic saturation. Therefore, the saturation magnetization of the magnetic layer 12*b* may be 0.6 T or more, specifically, 0.8 T or more, or more specifically, 1.2 T or more. For example, when the saturation magnetization of the magnetic layer 12*b* is 0.6 T or more, the inductor may operate without magnetic saturation even if a current of 1 A is flown through the inductor conductive part 12*a* with a diameter of 50 mm. In view of a material of the magnetic layer 12*b* to be actually used, the upper limit of the saturation magnetization of the magnetic layer 12*b* may be approximately 2 T.

Even if the inductor 12 is driven at a high switching frequency, a current is confined to the inductor conductive part 12*a* to reduce resistance in the inductor 12. Therefore, the resistivity of the magnetic layer 12*b* may be 10 times or more, or specifically, 50 times or more the resistivity of the inductor conductive part 12*a*. For example, when the inductor conductive part 12*a* is formed by Cu (with a resistivity of 1.68E−8 Ω·m), the resistivity of the magnetic layer 12*b* may be 1.68E−7 Ω·m or more.

Because the inductor 12 may operate at a high switching frequency, the coercive force of the magnetic layer 12*b* may be 800 A/m or less, or specifically, 2 A/m or less. In view of a material of the magnetic layer 12*b* to be actually used, the lower limit of the coercive force of the magnetic layer 12*b* may be approximately 2 A/m.

With a switching frequency of 1 MHz or more, if the thickness of the magnetic layer 12*b* is larger than 10 μm, an eddy current generated in the magnetic layer 12*b* becomes larger. In addition, with a switching frequency of 100 MHz or more, if the thickness of the magnetic layer 12*b* is larger than 1 μm, an eddy current generated in the magnetic layer 12*b* becomes larger. Therefore, the thickness of the magnetic layer 12*b* may be 10 μm or less, or specifically, 1 μm or less. In view of the mechanical strength of the magnetic layer 12*b*, the lower limit of the thickness of the magnetic layer 12*b* may be approximately 0.1 μm.

As a forming material of the magnetic layer 12*b*, a Fe—Ni alloy such as permalloy, a Fe—Co alloy, soft magnetic ferrite, or the like may be used, for example. From a viewpoint of a large relative permeability and saturation magnetization, permalloy may be used. From a viewpoint of a high resistivity, ferrite may be used.

The inductor conductive part 12*a* may not have a magnetic property. The relative permeability of the inductor conductive part 12*a* may be close to 1.

To allow a current to flow through the inductor conductive part 12*a* easily to reduce a power loss, the resistivity of the inductor conductive part 12*a* may be low. For example, the resistivity of the inductor conductive part 12*a* may be 1E−7 Ω·m or less, or more specifically, 5E−8 Ω·m or less.

As a forming material of the inductor conductive part 12*a*, Cu, Al, an alloy of them (brass, phosphor bronze, or Al—Si alloy), or the like may be used, for example.

The relative permeability and resistivity of the inductor 12 may be controlled by the cross-sectional area of the inductor conductive part 12*a* and the thickness, forming material, heat treatment conditions, or the like of the magnetic layer 12*b*.

If the inductor substrate 11 has a magnetic property, a parasitic inductance may be generated in the inductor substrate 11, possibly affecting operation of the power supply. Therefore, the inductor substrate 11 may not have a magnetic property. The relative permeability of the inductor substrate 11 may be close to 1.

To suppress a parasitic capacity of the inductor substrate 11 and reduce a power loss, the relative permittivity of the inductor substrate 11 may be 10 or less, or more specifically, 6 or less.

To suppress a leak current to reduce a power loss, the resistivity of the inductor substrate 11 may be high. For example, the resistivity of the inductor substrate 11 may be 1E−7 Ω·m or more.

Figure 6:
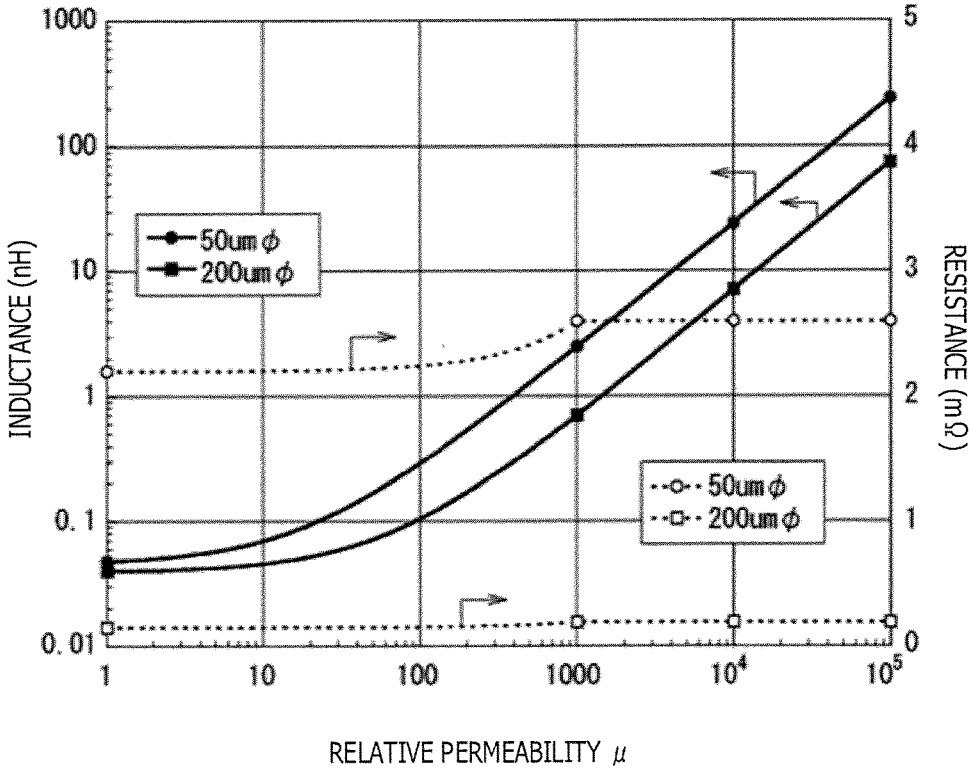
FIG. 6 illustrates an example of a relationship of inductance and relative permeability of an inductor and a relationship of resistance and relative permeability of an inductor.

FIG. 6 illustrates an example of a relationship of inductance and relative permeability of an inductor and a relationship of resistance and relative permeability of an inductor.

FIG. 6 illustrates the relationship of the inductance and the relative permeability of the inductor 12 and the relationship of the resistance and the relative permeability of the inductor 12 when the inductor 12 has the inductor conductive part 12*a* that is formed by Cu and is 300 μm in length and the magnetic layer 12*b* that is formed by permalloy and is 1 μm in thickness. The relationship is illustrated under two conditions: the diameters of the inductor conductive part 12*a* are 50 μm and 200 μm. The horizontal axis of FIG. 6 represents the relative permeability of the magnetic layer 12*b*.

When the relative permeability of the magnetic layer 12*b* is changed, the inductance of the inductor 12 changes in a range from several nH to several hundred nH.

In a wide range of the relative permeability, the resistance of the inductor 12 may be set to 3 mΩ or less.

In the inductor apparatus 10, for example, when each inductor 12 has the inductor conductive part 12*a* that is 50 μm in diameter and the magnetic layer 12*b* that is 1 μm in thickness, and the inductors 12 are disposed in an array form at a spacing of 100 μm, a high-density arrangement of 100 inductors/$mm^2$ is provided.

As described above, in the inductor apparatus 10, the inductors 12 with a high inductance and a low resistance may be disposed in high density.

Figure 7:
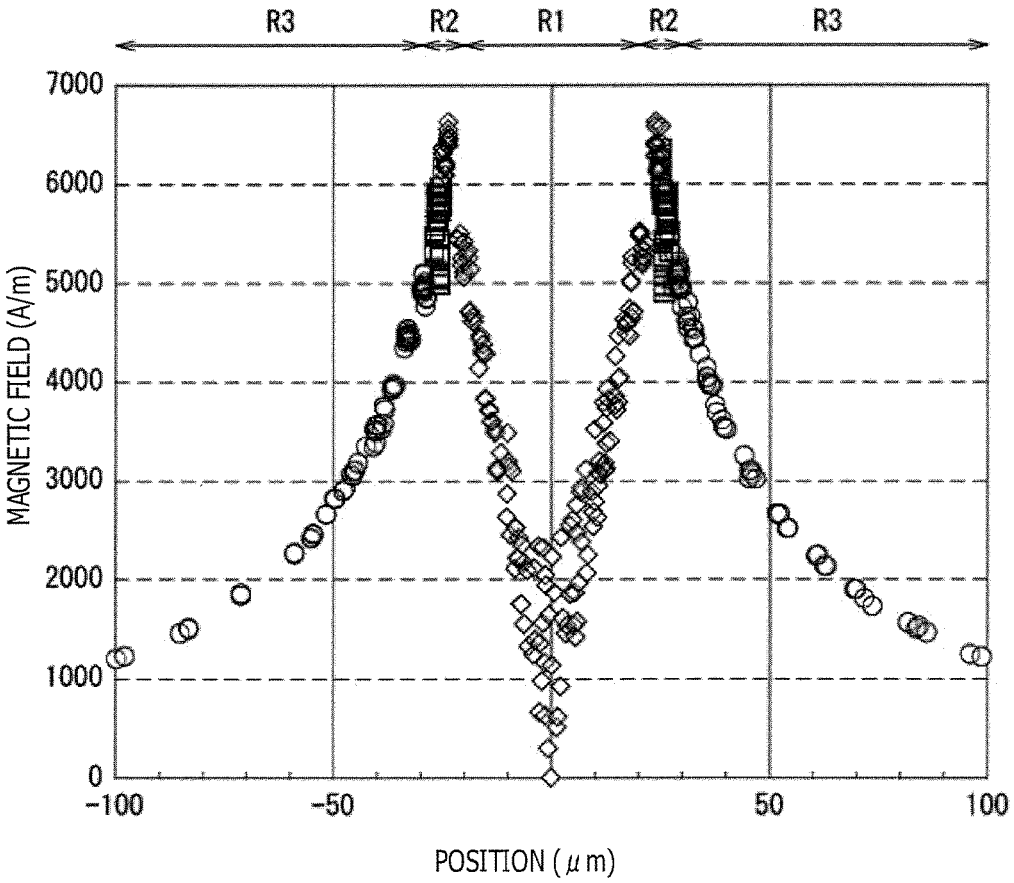
FIG. 7 illustrates an example of distribution of a magnetic field of an inductor.

FIG. 7 illustrates an example of distribution of a magnetic field of an inductor.

The horizontal axis of FIG. 7 represents the position of the inductor 12 in a width direction. The width direction of the inductor 12 may be oriented orthogonal to a longitudinal direction. A region R1 may be a portion of the inductor conductive part 12*a*, a region R2 may be a portion of the magnetic layer 12*b*, and a region R3 may be a portion of air.

Because there is a large difference in relative permeability between the magnetic layer 12*b* and the inductor conductive part 12*a*, the magnetic field is confined to the magnetic layer 12*b* as illustrated in FIG. 7. The magnetic field is oriented in a circumferential direction of the magnetic layer 12*b* having a cylindrical shape, and the orientation of a line of magnetic force does not intersect the magnetic layer 12*b*. Therefore, the generation of an eddy current in the magnetic layer 12*b* may be reduced.

Figure 8:
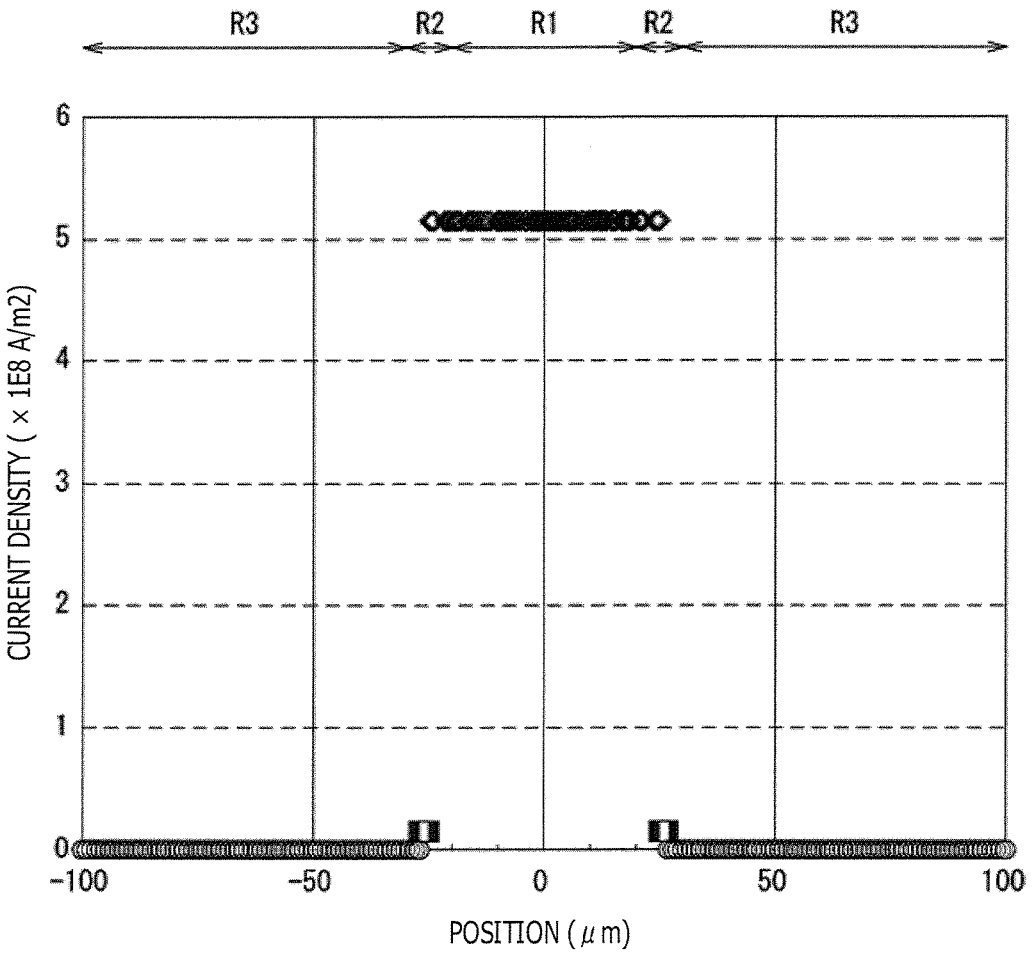
FIG. 8 illustrates an example of distribution of a current density of an inductor.

FIG. 8 illustrates an example of distribution of a current density of an inductor.

The horizontal axis of FIG. 8 represents the position of the inductor 12 in a width direction. The description of the horizontal axis in FIG. 7 may be applied to FIG. 8.

As illustrated in FIG. 8, the current density is high in the inductor conductive part 12*a* and very low in the magnetic layer 12*b*. Because there is a large difference in resistivity between the inductor conductive part 12*a* and the magnetic layer 12*b*, a current flowing through the inductor 12 mainly flows through the inductor conductive part 12*a*.

Figure 9:
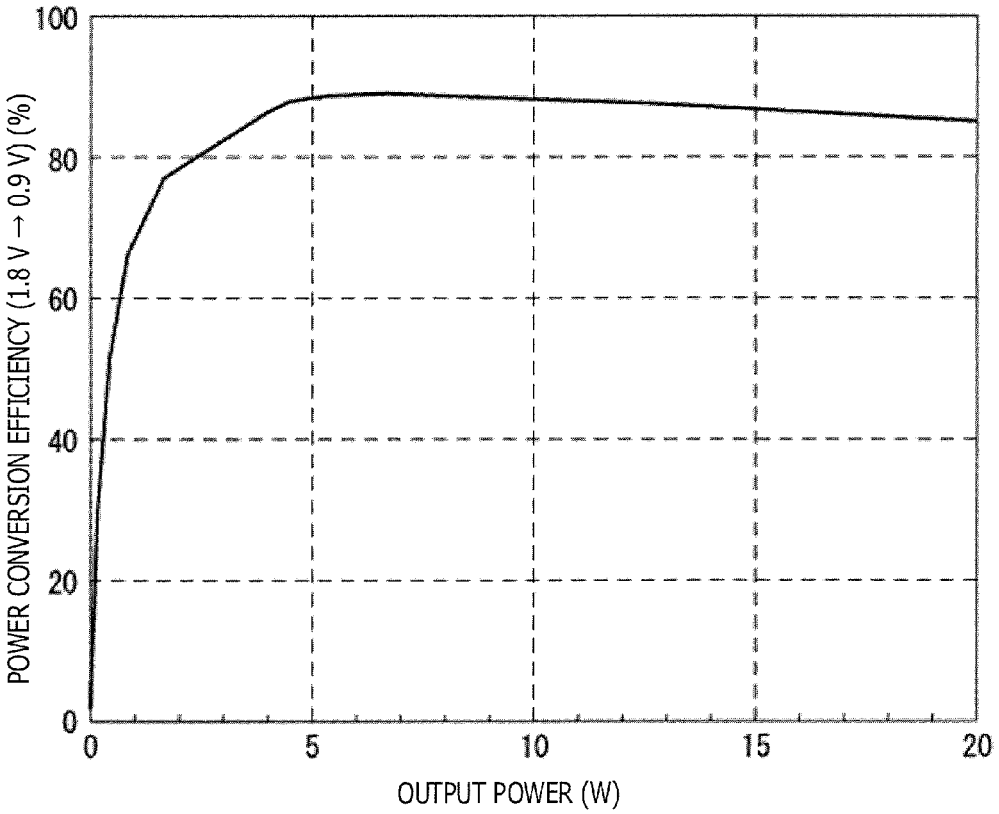
FIG. 9 illustrates an example of a relationship of a power conversion efficiency and output power of an inductor apparatus.

FIG. 9 illustrates an example of a relationship of a power conversion efficiency and output power of an inductor apparatus.

FIG. 9 indicates a result of investigating the relationship of the power conversion efficiency and the output power after the power supply illustrated in FIG. 4 is manufactured using the inductor apparatus. The inductor 12 has the inductor conductive part 12*a* that is formed by Cu and is 300 μm in length and the magnetic layer 12*b* that is formed by permalloy, is 50 μm in diameter, and is 1 μm in thickness. The inductance of the inductor 12 may be 5 nH. The power supply having 12 phases is formed using 12 inductors 12. The inductors 12 may be disposed at a spacing of 200 μm. A switching frequency for driving pairs of transistors may be 200 MHz. The transistors are formed using a miniaturization technology for a rule with a line width of 0.18 μm, and on-resistance of the transistors may be 20 mΩ. The capacity of the capacitive element may be 10 nF.

As illustrated in FIG. 9, in a wide range of the output power, the power conversion efficiency for outputting the DC power that is stepped down from 1.8 V to 0.9 V indicates a value close to 90%. The output of the inductor apparatus 10 with respect to the size of an array of the inductors 12 is 20 W output/0.6 square millimeter, and a high efficiency is indicated by using high-density inductors.

Figure 10:
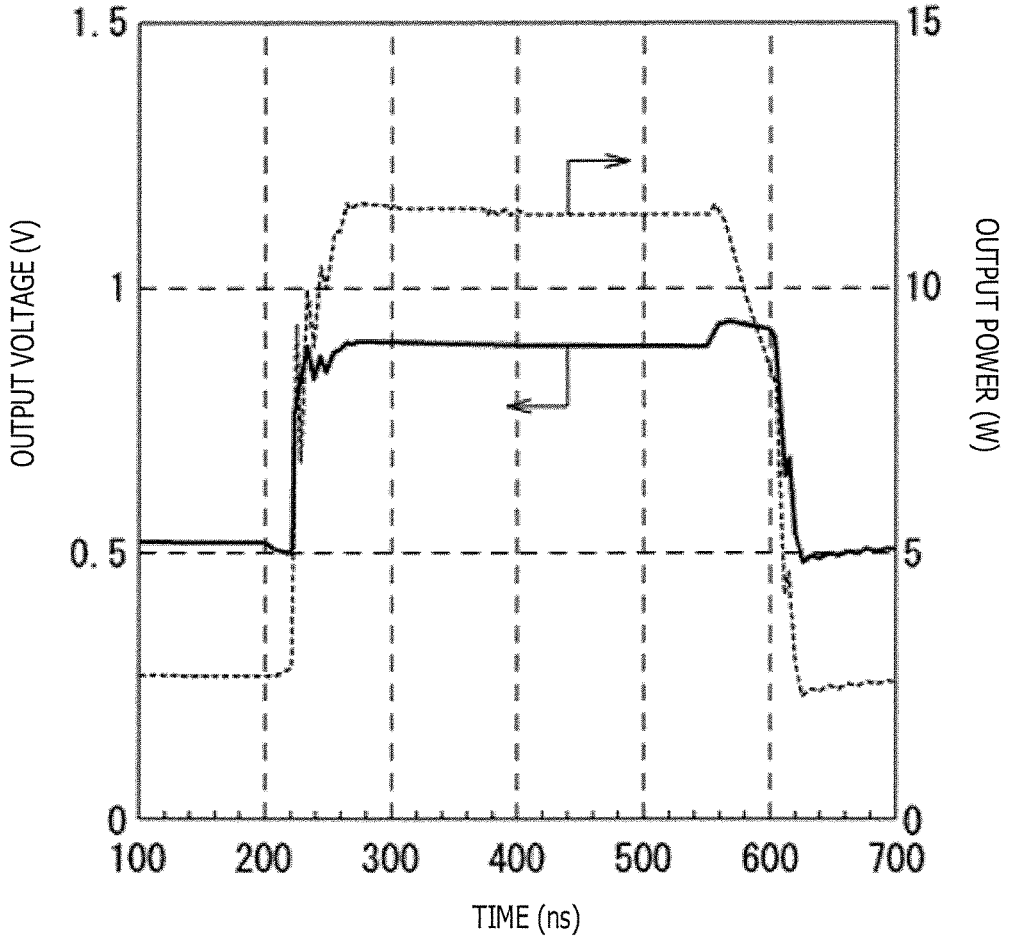
FIG. 10 illustrates an example of a relationship of an output voltage and output power of an inductor apparatus with time.

FIG. 10 illustrates an example of a relationship of an output voltage and output power of an inductor apparatus with time.

FIG. 10 indicates a result of investigating the relationship of the output voltage and output power with time using the same inductor apparatus as described in FIG. 9.

For the output voltage and output power, the response time at rising and fallings edges is 50 ns or less. In response to abrupt load fluctuations, the voltage and frequency are controlled dynamically.

The inductor apparatus may have a high inductance and a low resistivity, and may have a small size at which the inductors are disposed in high density. The power supply manufactured using the inductor apparatus may have a high power conversion efficiency and a high responsivity.

Figure 11:
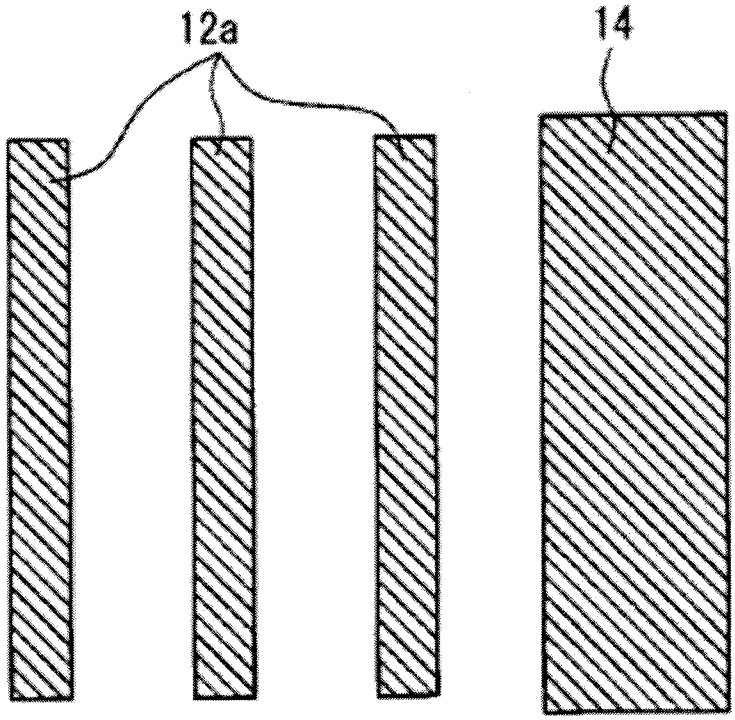
FIG. 11 illustrates an example of a method of manufacturing an inductor apparatus.

FIGS. 11 to 17 illustrate an example of a method of manufacturing an inductor apparatus. As illustrated in FIG. 11, the plurality of inductor conductive parts 12*a* and the first conductive part 14 that are vertically long and have an electrical conductivity are formed. The plurality of inductor conductive part 12*a* and the first conductive part 14 may be formed by, for example, machining a Cu material with a stamping method. For example, the inductor conductive part 12*a* of a Cu material with a diameter of 0.1 mm and a length of 0.5 mm is formed. For example, the first conductive part 14 of a Cu material with a diameter of 0.4 mm and a length of 0.5 mm is formed.

Figure 12:
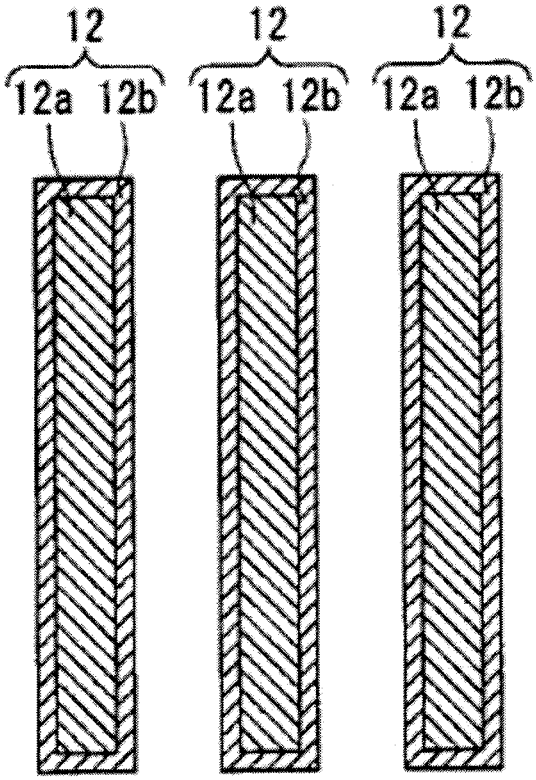
FIG. 12 illustrates an example of a method of manufacturing an inductor apparatus.

As illustrated in FIG. 12, the magnetic layers 12*b* of a soft magnetic material are formed on the sides of the plurality of inductor conductive parts 12*a*, and the plurality of inductors 12 are formed.

The plurality of inductor conductive parts 12*a* are degreased with an organic solvent (acetone or methanol, for example), and pickled to activate the surfaces. Then, plating with a magnetic layer is performed. For example, the plating may be performed using permalloy (Fe:Ni=22:78) as a magnetic layer with a thickness of 0.1 to 0.5 μm. The plating may be performed with a direct current plating method using a Ni plate as an anode and a Fe plate as a cathode, at room temperature (21° C.) with a current density of 5 to 20 mA/$cm^2$. For a boric-acid plating bath, 0.7 mol/L of $NiSO_4$, 0.2 mol/L of $NiCl_2$, 0.3 mol/L of $FeSO_4$, 0.4 mol/L of boric acid, and 0.014 mol/L of saccharin may be used.

For example, as an additive agent, saccharin may be used, or sodium lauryl sulfate or the like may be used. As a plating method, a direct current plating method, pulse plating method, or alternating current plating method may be used. The magnetic layer 12*b* may be formed with plating using CoFe series or CoNi series.

The relative permeability of the inductor 12 plated with the magnetic layer 12*b* may be approximately 1000. The inductance of the inductor 12 increases as the magnetic layer 12*b* increases in thickness. However, with an increase in thickness, a power loss caused by an eddy current increases.

After a magnetic layer is formed on a surface of an electrically conductive wire with a plating method, the inductor 12 may be formed by cutting the wire to a certain length.

The plurality of inductors 12 are heat-treated such that the magnetic layer 12*b* of each inductor 12 has a relative permeability of 5000 or more.

The inductor 12 is heat-treated at a temperature of 400° C. to 700° C. for 1 to 10 hours in a reducing atmosphere (for example, in hydrogen, nitrogen, a vacuum, or the like), and is then allowed to cool slowly. Accordingly, distortion in the magnetic layer 12*b* is relaxed and the relative permeability of the magnetic layer 12*b* is improved. The relative permeability of the heat-treated magnetic layer 12*b* may be improved to approximately 30000. In a thin-film inductor that has a conductive coil pattern and magnetic film core, distortion occurs due to a difference in thermal expansion coefficient between a substrate and magnetic film, and it may therefore be difficult to improve a relative permeability with heat treatment.

Figure 13:
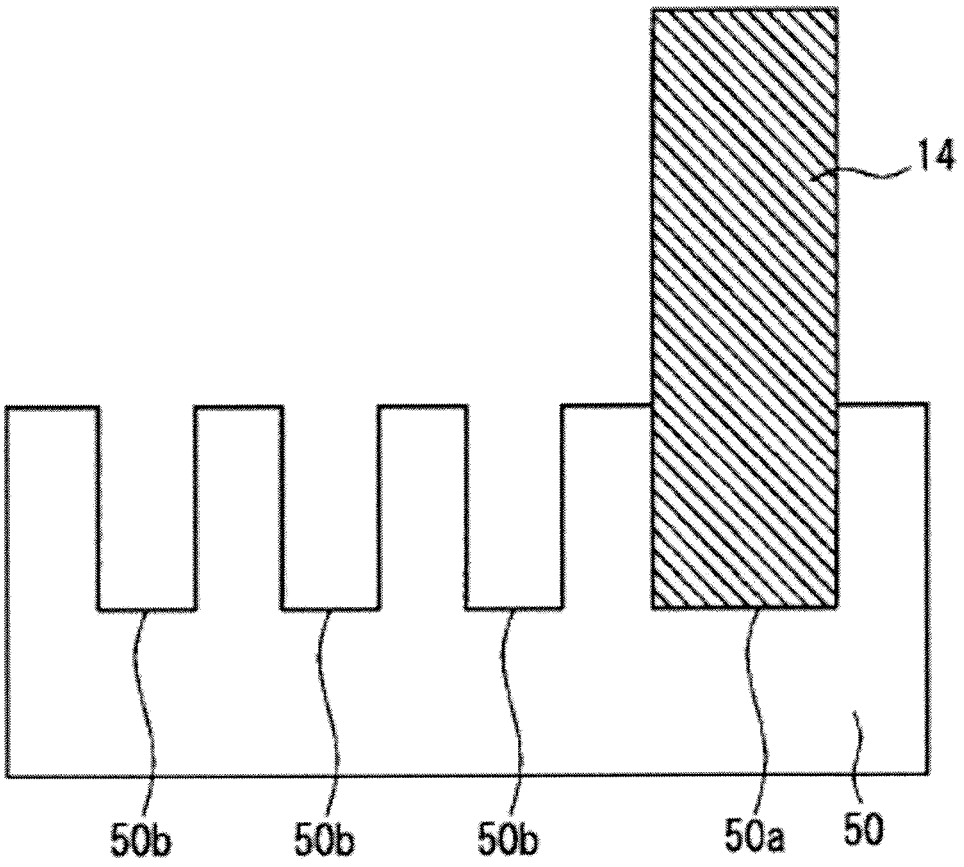
FIG. 13 illustrates an example of a method of manufacturing an inductor apparatus.

As illustrated in FIG. 13, a lower mold 50 has a large recess 50*a* and a plurality of small recesses 50*b*, and the first conductive part 14 is disposed in the recess 50*a* of the lower mold 50. The shape of the large recess 50*a* corresponds to the first conductive part 14. The shape of the small recess 50*b* corresponds to the inductor 12, and the first conductive part 14 may not be inserted into the small recess 50*b*. The first conductive part 14 is disposed in the lower mold 50 while a part in a longitudinal direction of the first conductive part 14 is inserted into the recess 50*a*. A mold release agent is applied to the recess 50*a* and the recesses 50*b*.

After the plurality of first conductive parts 14 are distributed on the lower mold 50, the lower mold 50 is vibrated and one or some of the first conductive parts 14 is dropped into the recess 50*a*. The remaining first conductive parts 14 may be collected.

Figure 14:
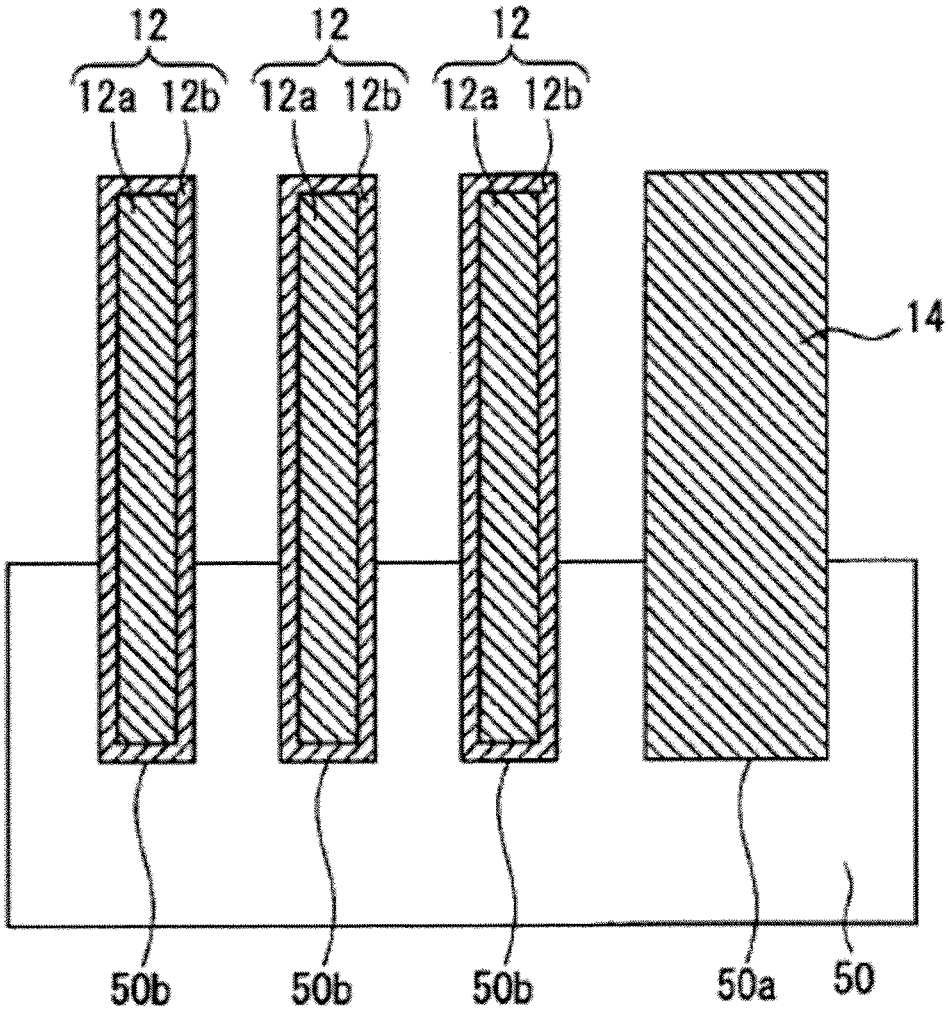
FIG. 14 illustrates an example of a method of manufacturing an inductor apparatus.

As illustrated in FIG. 14, the inductor 12 is disposed in the small recess 50*b*. The inductor 12 is disposed in the lower mold 50 while a part in a longitudinal direction of the inductor 12 is inserted into the recess 50*b*.

After the plurality of inductors 12 are distributed on the lower mold 50, the lower mold 50 is vibrated and one or some of the inductors 12 are dropped into the recesses 50*b*. The remaining inductors 12 may be collected. Because the first conductive part 14 has already been disposed in the large recess 50*a*, the inductor 12 may not be disposed in the large recess 50*a*. As described above, the plurality of inductors 12 are disposed in the lower mold 50 aligning the longitudinal direction and with a spacing.

Figure 15:
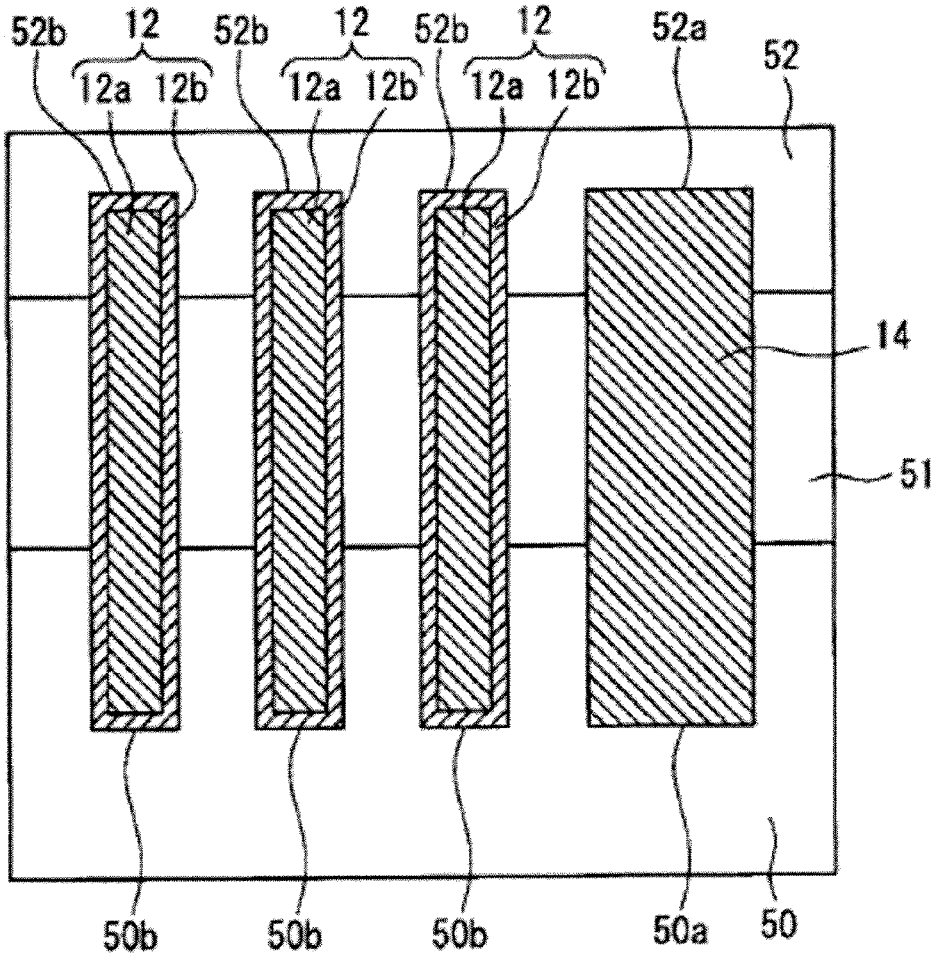
FIG. 15 illustrates an example of a method of manufacturing an inductor apparatus.

As illustrated in FIG. 15, an upper mold 52 has a large recess 52*a* and a plurality of small recesses 52*b*, and is disposed so as to face the lower mold 50 such that the first conductive part 14 is inserted into the recess 52*a* and the inductors 12 are inserted into the recesses 52*b*. The shape of the large recess 52*a* corresponds to the first conductive part 14. The shape of the small recess 52*b* corresponds to the inductor 12. A mold release agent is applied to the recess 52*a* and the recesses 52*b*.

Under reduced pressure, a resin 51 that has an electrical insulation property and is of a non-magnetic material is injected between the plurality of inductors 12. When the resin 51 is injected between the plurality of inductors 12 under reduced pressure, bubbles included in the resin 51 may be reduced. The resin 51 is injected into the space formed between the upper mold 52 and the lower mold 50.

As the resin 51, a light curing resin may be used. The upper mold 52 may be formed using a material that transmits light with which the resin 51 is irradiated to cure the resin 51.

When the resin 51 is cured by irradiating the resin 51 with light from above the upper mold 52, the inductor substrate 11 that supports the plurality of inductors 12 is formed.

As the resin 51, a light curing resin may be used, or an epoxy resin that is cured by mixing two liquids may be used. In this case, a material that transmits light may not be used for the upper mold 52, and a durable material such as a metal may be used.

Figure 16:
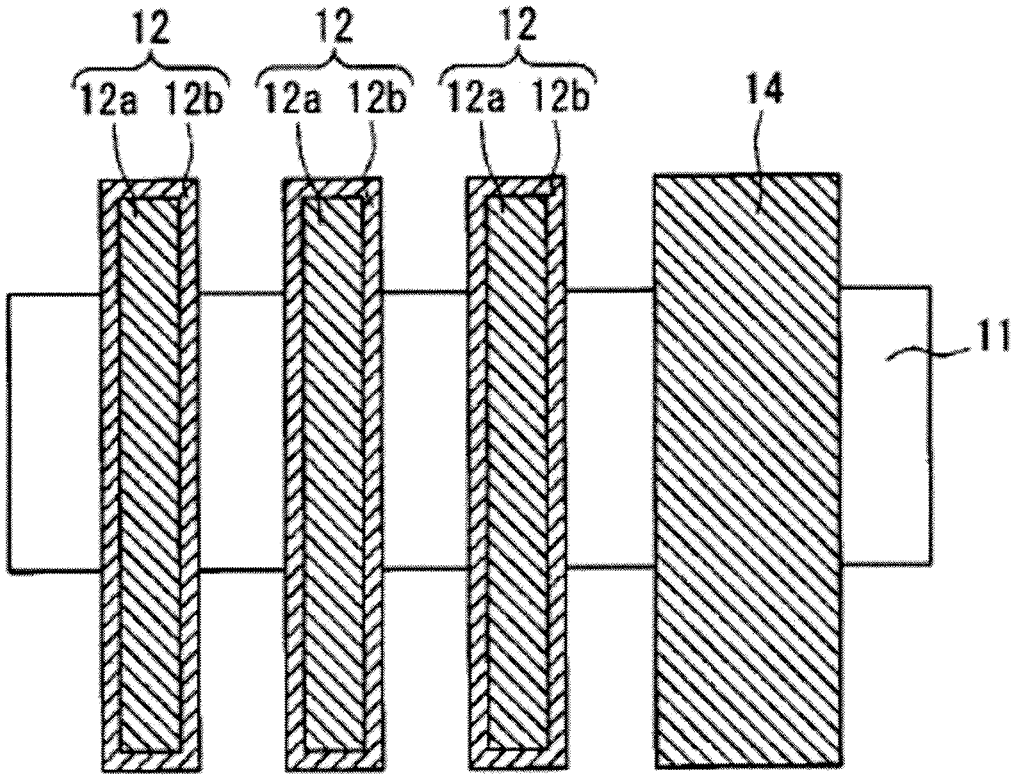
FIG. 16 illustrates an example of a method of manufacturing an inductor apparatus.

As illustrated in FIG. 16, the upper mold 52 and the lower mold 50 are removed from the inductor substrate 11.

Figure 17:
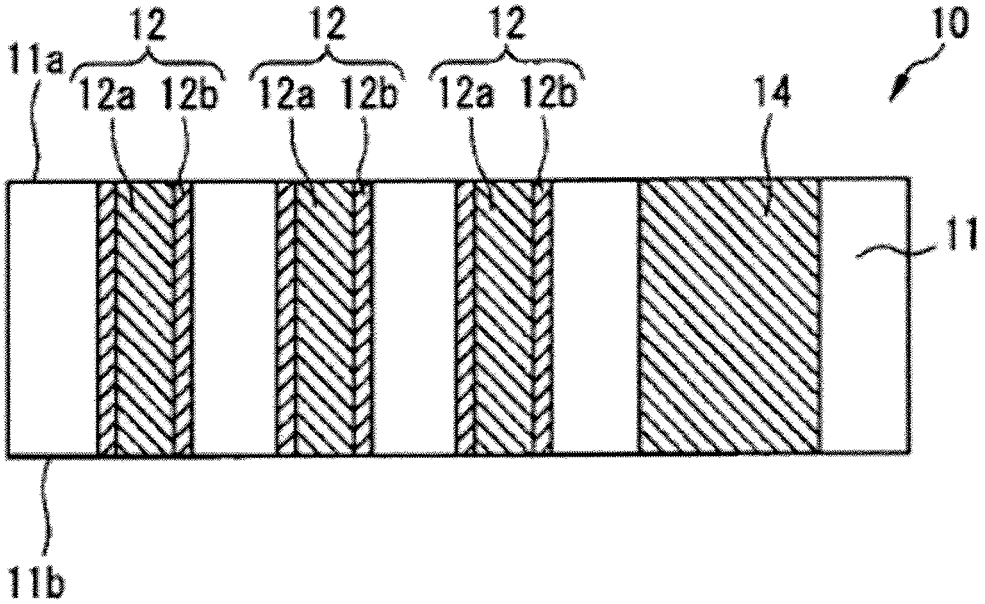
FIG. 17 illustrates an example of a method of manufacturing an inductor apparatus.

As illustrated in FIG. 17, after the portions of the inductors 12 projecting from the first surface 11*a* and the second surface 11*b* of the inductor substrate 11 are cut, the first surface 11*a* and the second surface 11*b* are polished and the inductor apparatus 10 is obtained.

The inductor apparatus 10 that includes the 0.3 mm-long inductor 12 having the 0.5 μm-thick magnetic layer 12*b* may be formed. The inductor 12 may have a resistance of 0.5 mΩ and an inductance of 20 nH.

The inductance of the inductor 12 may be adjusted by changing the diameter of the inductor conductive part 12*a*, the Fe:Ni ratio of permalloy, the thickness of the magnetic layer 12*b*, heat treatment conditions, or the like.

In the inductor apparatus manufacturing method, when the magnetic layer 12*b* of the inductor 12 is heat-treated, the relative permeability of the magnetic layer 12*b* may be enhanced to 5000 or more and a high inductance may be obtained. A small-sized inductor apparatus may be manufactured with ease.

Figure 18:
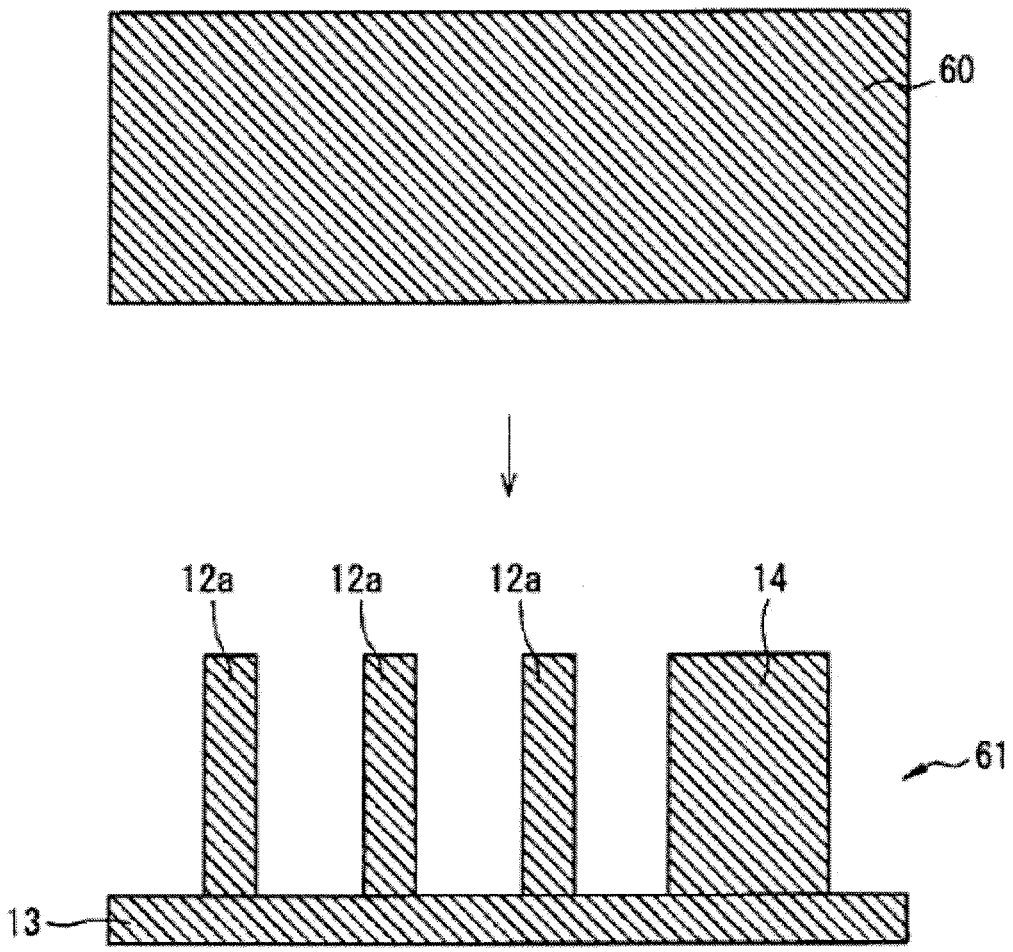
FIG. 18 illustrates an example of a method of manufacturing an inductor apparatus.

FIGS. 18 to 24 illustrate an example of a method of manufacturing an inductor apparatus. As illustrated in FIG. 18, an electrically conductive block 60 is machined to obtain a conductive complex 61 in which a plate-like connection conductive layer 13 is formed, and the plurality of inductor conductive parts 12*a* and the first conductive part 14 are formed on a surface of the connection conductive layer 13 so as to extend outward from the surface of the connection conductive layer 13.

As the block 60, a Cu block may be used. The conductive complex 61 may be formed by etching or grinding the block 60.

Figure 19:
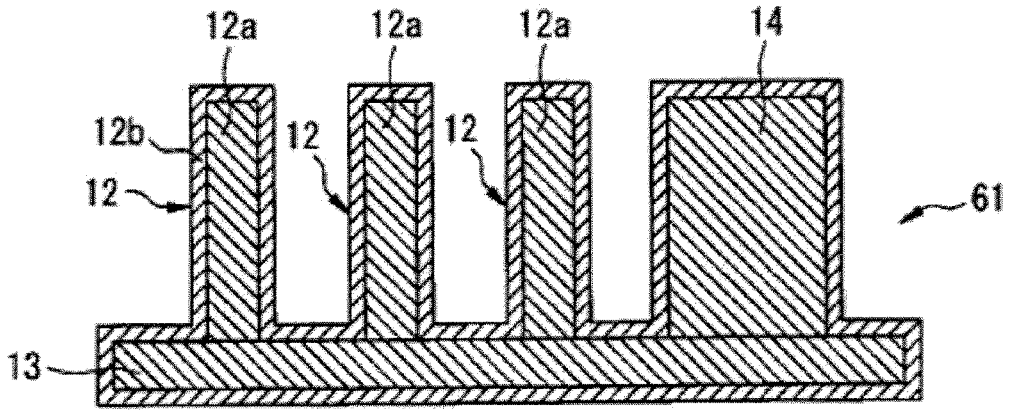
FIG. 19 illustrates an example of a method of manufacturing an inductor apparatus.

As illustrated in FIG. 19, the magnetic layers 12*b* of a soft magnetic material are formed on the surfaces of the plurality of inductor conductive parts 12*a* to form the plurality of inductors 12. The magnetic layers 12*b* are also formed on the surfaces of the first conductive part 14 and the connection conductive layer 13. As a method of forming the magnetic layer 12*b*, a method may be used which is substantially the same as or similar to the method described above.

The conductive complex 61 having the plurality of inductors 12 is heat-treated such that the magnetic layers 12*b* of the plurality of the inductors 12 have a relative permeability of 5000 or more.

Figure 20:
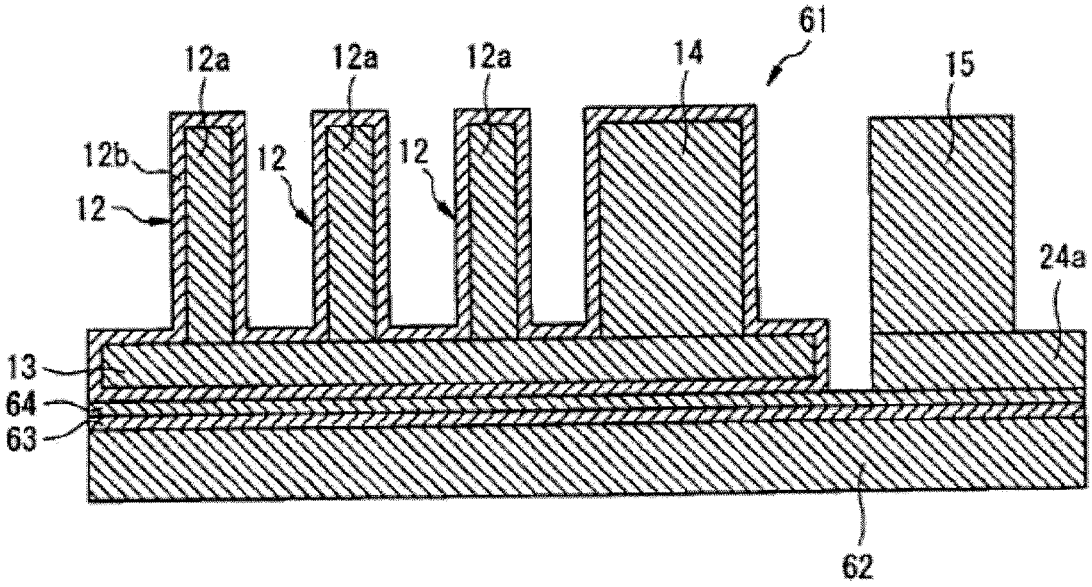
FIG. 20 illustrates an example of a method of manufacturing an inductor apparatus.

As illustrated in FIG. 20, the conductive complex 61 with the magnetic layers 12*b* formed is detachably bonded to a plate-like support 62. In the conductive complex 61, the connection conductive layer 13 is bonded to the support 62 via a first bonding layer 63 and a second bonding layer 64.

The first bonding layer 63 bonds the support 62 and the second bonding layer 64. The second bonding layer 64 bonds the first bonding layer 63 and the connection conductive layer 13.

The first bonding layer 63 may have bonding strength anisotropy in which the bonding strength of the support 62 in a planar direction is strong but the bonding strength of the support 62 in a vertical direction is weak. The connection conductive layer 13, to which the second bonding layer 64 is bonded, may be detached easily from the support 62, to which the first bonding layer 63 is bonded, by separating the connection conductive layer 13 in the vertical direction. As the first bonding layer 63, for example, a bonding layer may be used on which a projection that has a plurality of openings on an adhesive surface is disposed.

As a forming material of the support 62, a metal plate such as a Si substrate, glass substrate, aluminum plate, stainless plate, or a copper plate, a polyimide film, a printed substrate, or the like may be used, for example. As a film for forming the bonding layer, a polyimide resin, silicone resin, fluorine resin, or the like may be used, for example. As an adhesive that gives a bonding property to the bonding layer, an epoxy resin, acrylic resin, polyimide resin, silicone resin, urethane resin, or the like may be used.

To bond the conductive complex 61 on the support 62, to which the first bonding layer 63 and the second bonding layer 64 are bonded, a flip-chip bonder may be used, for example.

A separately formed wiring layer 24*a* having the second conductive part 15, together with the conductive complex 61, is bonded to the support 62 via the first bonding layer 63 and the second bonding layer 64.

Figure 21:
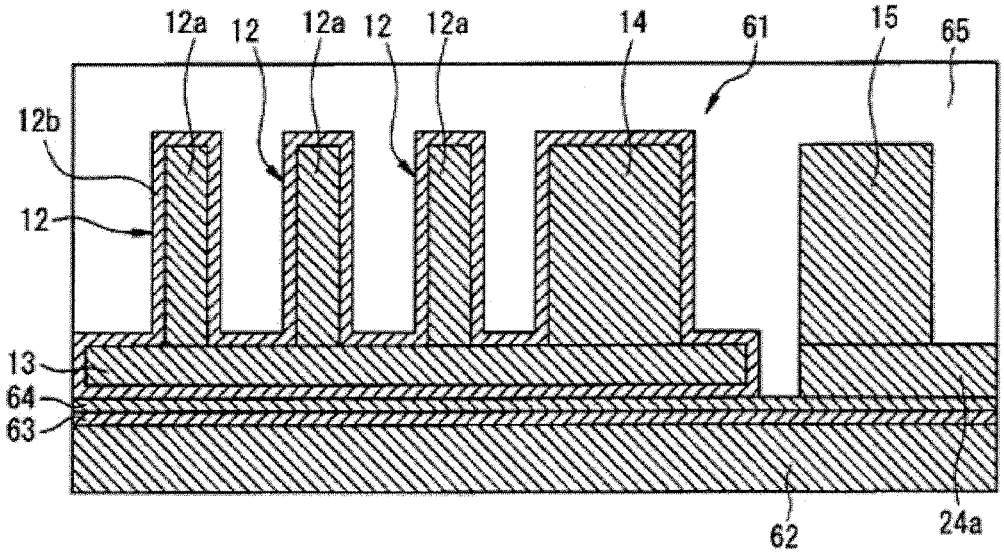
FIG. 21 illustrates an example of a method of manufacturing an inductor apparatus.

As illustrated in FIG. 21, a resin 65 that has an electrical insulation property and is of a non-magnetic material is injected between the plurality of inductors 12 and between the first conductive part 14 and the inductor 12 using a mold. The resin 65 is injected so as to embed the second conductive part 15 as well. As the resin 65, a thermosetting resin may be used.

The resin 65 may include an inorganic filler. As the inorganic filler, particles of alumina, silica, aluminum hydroxide, or aluminum nitride may be used, for example.

Figure 22:
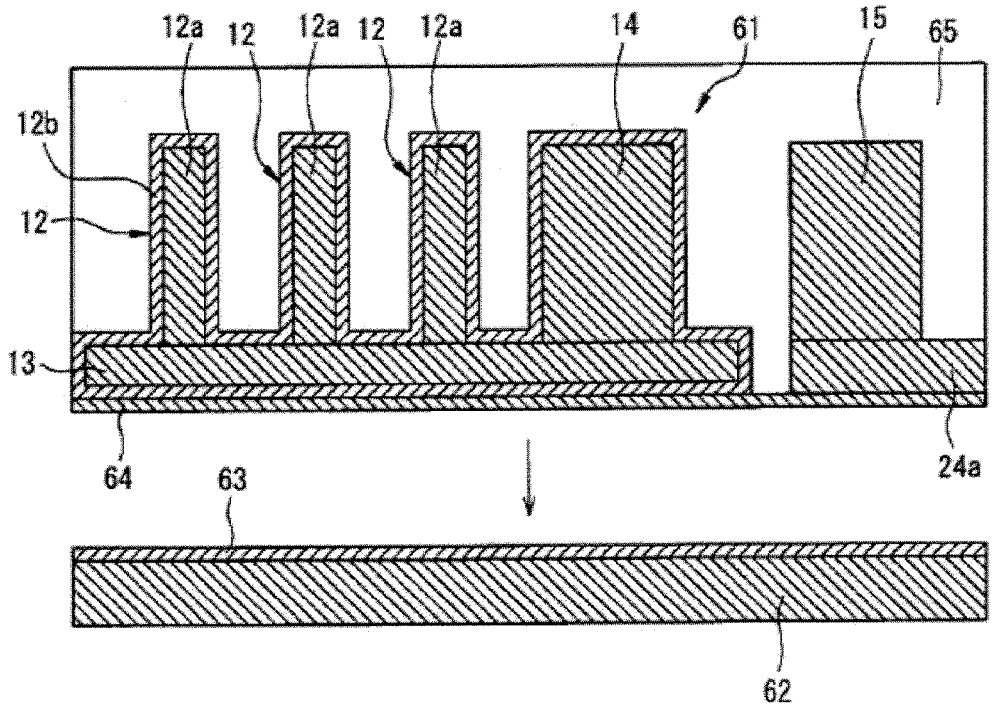
FIG. 22 illustrates an example of a method of manufacturing an inductor apparatus.

As illustrated in FIG. 22, the second bonding layer 64 is detached from the first bonding layer 63 to remove the support 62.

Figure 23:
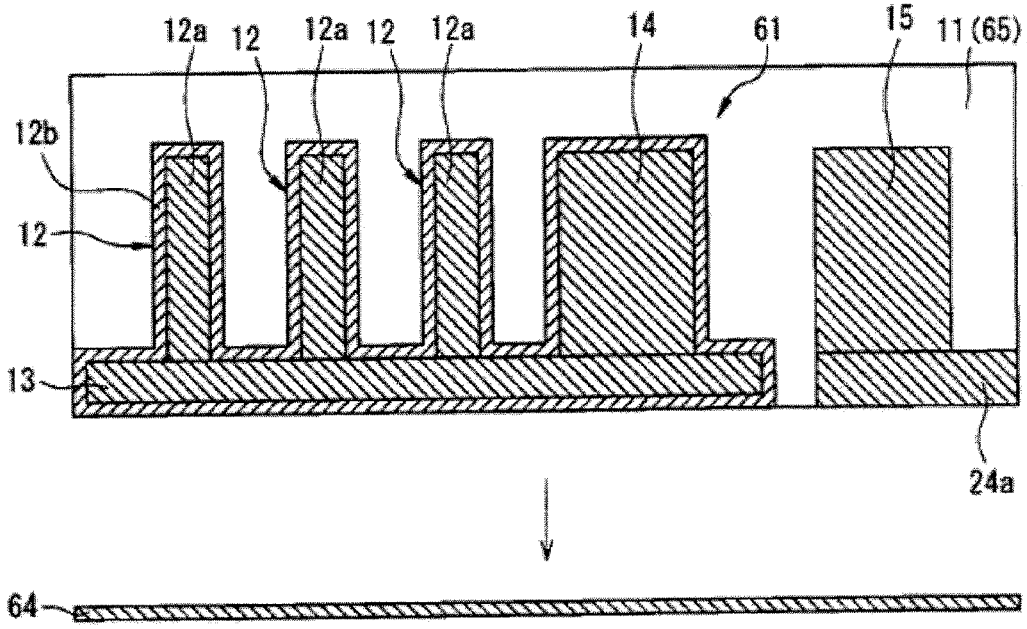
FIG. 23 illustrates an example of a method of manufacturing an inductor apparatus.

As illustrated in FIG. 23, the second bonding layer 64 is removed from the connection conductive layer 13 and the wiring layer 24*a*. The resin 65 is cured by heat treatment to form the inductor substrate 11 that supports the plurality of inductors 12 and the first conductive part 14. The inductor substrate 11 supports the second conductive part 15, in addition to the plurality of inductors 12 and the first conductive part 14.

Figure 24:
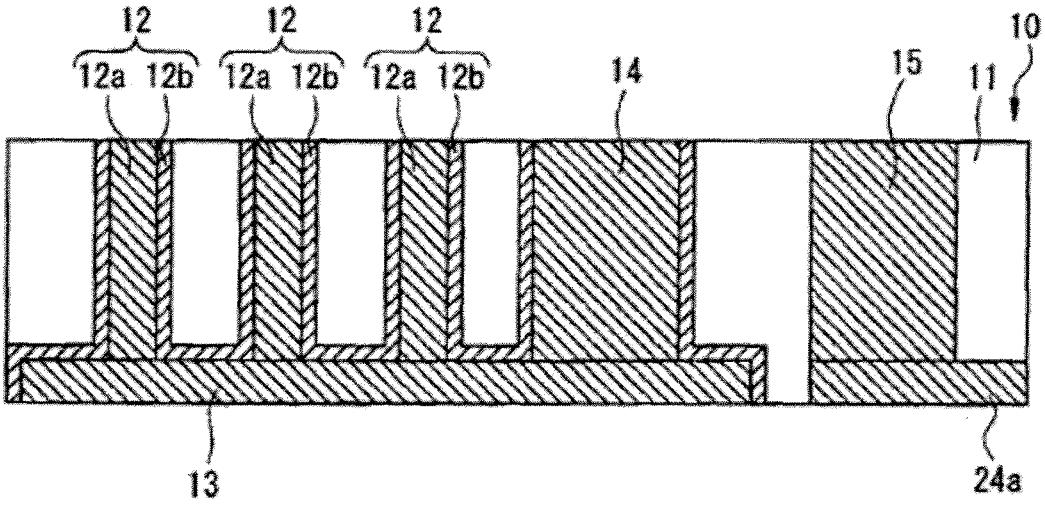
FIG. 24 illustrates an example of a method of manufacturing an inductor apparatus.

As illustrated in FIG. 24, when the surface of the inductor substrate 11, the surfaces of the magnetic layers 12*b* on the connection conductive layer 13, and the surface of the wiring layer 24*a* are polished to expose the inductor conductive parts 12*a*, the first conductive part 14, the second conductive part 15, the connection conductive layer 13, and the wiring layer 24*a*, the inductor apparatus 10 is obtained.

After a conductive complex continuum may be formed in which a plurality of conductive complexes are coupled by connection conductive layers and the wiring layers, individual inductor apparatuses may be formed by cutting the connection conductive layers and the wiring layers.

In the inductor apparatus manufacturing method illustrated in FIGS. 18 to 24, effects may be produced which are substantially the same as or similar to the effects of the inductor apparatus manufacturing method illustrated in FIGS. 11 to 17.

Magnetic layers may be formed on the entire conductive complex, or magnetic layers may be formed on portions that include inductor conductive parts.

Figure 25:
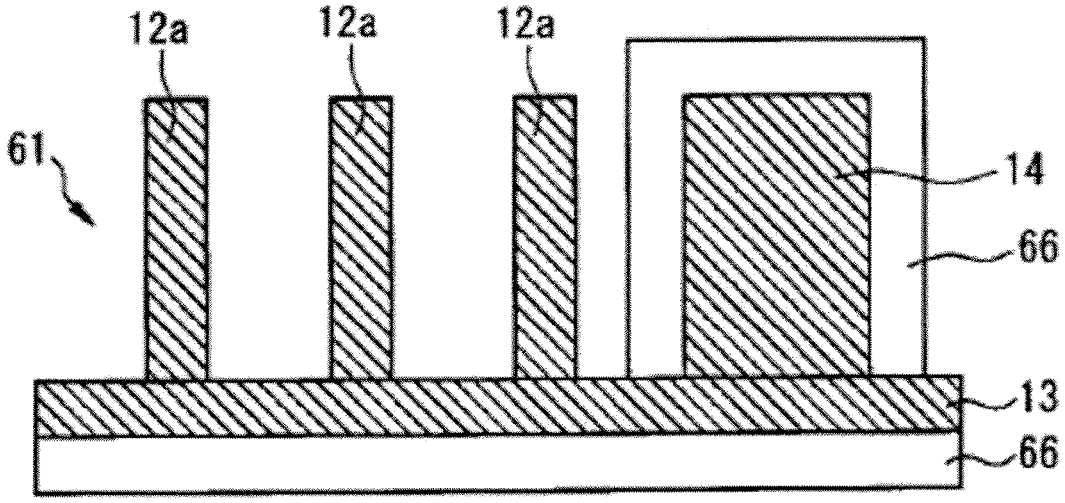
FIG. 25 illustrates an example of a method of manufacturing an inductor apparatus.
Figure 26:
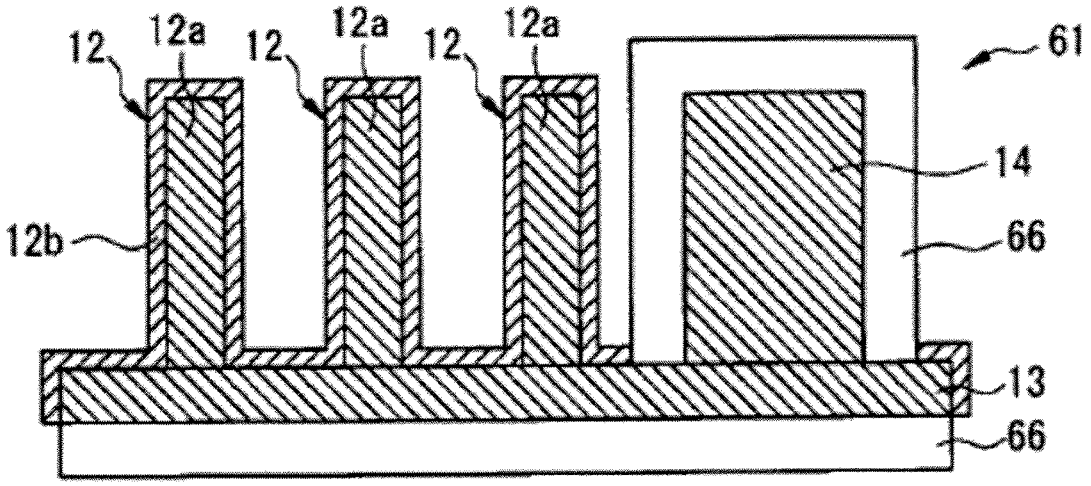
FIG. 26 illustrates an example of a method of manufacturing an inductor apparatus.
Figure 27:
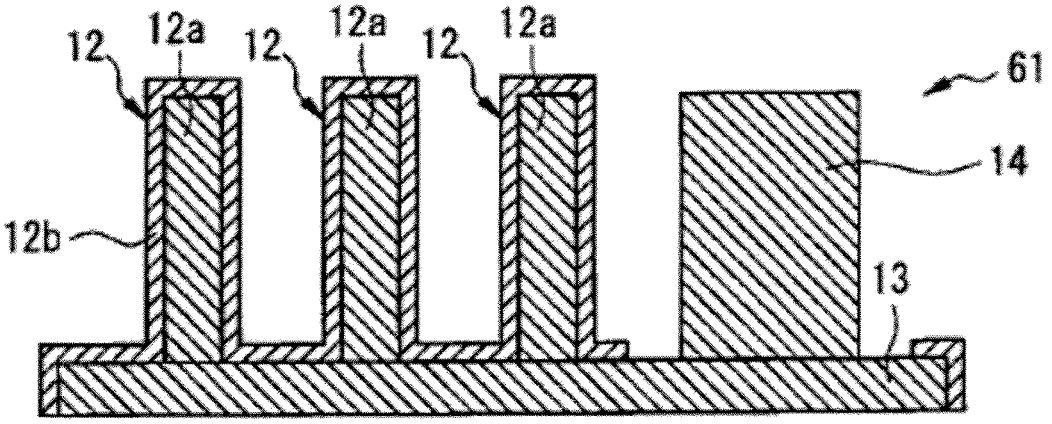
FIG. 27 illustrates an example of a method of manufacturing an inductor apparatus.

FIGS. 25 to 27 illustrate an example of a method of manufacturing an inductor apparatus. For example, the conductive complex 61 is formed as illustrated in FIG. 25.

As illustrated in FIG. 25, in the conductive complex 61, a mask 66 is formed on the surface of the first conductive part 14 and the back side of the connection conductive layer 13.

As illustrated in FIG. 26, the magnetic layers 12*b* are formed on the conductive complex 61 on which the masks 66 are formed, and the inductors 12 are formed in which the magnetic layers 12*b* are formed on the surfaces of the inductor conductive parts 12*a*.

As illustrated in FIG. 27, the masks 66 are removed, and the conductive complex 61 having the plurality of inductors 12 is formed.

Subsequent processes may be substantially the same as or similar to the processes in the inductor apparatus manufacturing method illustrated in FIGS. 18 to 24.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An inductor apparatus comprising:

a substrate including an electrical insulation property and a non-magnetic material;

a plurality of inductors disposed in the substrate so as to extend from a first surface of the substrate to a second surface of the substrate;

a first conductive part arranged side by side with the plurality of inductors in a direction orthogonal to a longitudinal direction of the plurality of inductors on one side of the plurality of inductors and disposed in the substrate so as to extend from the first surface of the substrate to the second surface of the substrate;

a connection conductive layer that is disposed at the second surface of the substrate and electrically couples one end of each of the plurality of inductors and a first end of the first conductive part;

a capacitive element that is disposed at a third surface of the connection conductive layer in which the one end of each of the plurality of inductors and the one end of the first conductive part are not coupled, wherein the capacitive element is coupled to a first wiring layer disposed at a fourth surface of a connection substrate arranged side by side with the substrate; and a second wiring layer that is disposed at the first surface of the substrate, wherein the second wiring layer is coupled to a second end of the of the first conductive part and extends along a fifth surface of the connection substrate that is opposite to the fourth surface of the connection substrate, wherein each of the plurality of inductors includes:

an inductor conductive part that has an electrical conductivity and extends in a thickness direction of the substrate; and a magnetic layer that covers a side of the inductor conductive part and include a relative permeability and a soft magnetic material.

2. The inductor apparatus according to claim 1, wherein the relative permeability is 5000 or more.

3. The inductor apparatus according to claim 1, wherein a resistivity of the magnetic layer is 10 times or more a resistivity of the inductor conductive part.

4. The inductor apparatus according to claim 1, wherein a thickness of the magnetic layer is 10 μm or less.

5. The inductor apparatus according to claim 1, wherein a coercive force of the magnetic layer is 2 A/m or less.

6. The inductor apparatus according to claim 1, wherein a saturation magnetization of the magnetic layer is 0.8 T or more.

7. The inductor apparatus according to claim 1, wherein other ends of each of the plurality of inductors is coupled to a power drive part disposed on a side of the first surface of the substrate and the second end of the first conductive part is coupled to a central processing unit via the second wiring layer.

8. The inductor apparatus according to claim 1, wherein the plurality of inductors are disposed in a thickness direction of the substrate via a part of the substrate.

9. The inductor apparatus according to claim 1, wherein a diameter of the first conductive part is larger than a diameter of the inductor conductive part and the magnetic layer of each of the plurality of inductors.

10. The inductor apparatus according to claim 1, wherein the first wiring layer is coupled to a power drive part via a second conductive part disposed in the connection substrate.

11. The inductor apparatus according to claim 10, wherein another plurality of inductors including the plurality of the inductors are disposed in a matrix and the first conductive part is disposed in a straight line with the plurality of the inductors.

* * * * *